US007466041B2

(12) United States Patent
Urman

(10) Patent No.: US 7,466,041 B2
(45) Date of Patent: Dec. 16, 2008

(54) WIRELESS POWERLESS SWITCH SENSOR

(75) Inventor: Robert Urman, Schaumburg, IL (US)

(73) Assignee: Wabtec Holding Corp., Wilmerding, PA (US)

( * ) Notice: Subject to any disclaimer, the term of this patent is extended or adjusted under 35 U.S.C. 154(b) by 0 days.

(21) Appl. No.: 11/817,353

(22) PCT Filed: Mar. 1, 2006

(86) PCT No.: PCT/US2006/007267

§ 371 (c)(1), (2), (4) Date: Jan. 24, 2008

(87) PCT Pub. No.: WO2006/096409

PCT Pub. Date: Sep. 14, 2006

(65) Prior Publication Data

US 2008/0110096 A1 May 15, 2008

Related U.S. Application Data

(60) Provisional application No. 60/658,645, filed on Mar. 4, 2005.

(51) Int. Cl.
*H01H 9/54* (2006.01)

(52) U.S. Cl. ..... 307/139

(58) Field of Classification Search ..... 307/139
See application file for complete search history.

(56) References Cited

U.S. PATENT DOCUMENTS

| | | | | |
|---|---|---|---|---|
| 6,125,768 | A | 10/2000 | Kurnik | |
| 6,768,451 | B2 | 7/2004 | Akopian et al. | |
| 6,863,220 | B2 | 3/2005 | Selker | |
| 2006/0091998 | A1 * | 5/2006 | Fitzgibbon | 340/5.71 |

* cited by examiner

*Primary Examiner*—Robert L DeBeradinis
(74) *Attorney, Agent, or Firm*—The Webb Law Firm

(57) ABSTRACT

A passenger door open request switch for use in a multi-passenger, mass-transit vehicle. A wireless, powerless switch sensor which includes an RFID reader, a circuit located remotely from the RFID reader that is formed by connecting an RFID antenna with a control/storage element, and a switch. The switch is connected between the antenna and the storage element in such a way as to either enable or disable the antenna. This allows the system to be configured to monitor the status of the switch.

1 Claim, 2 Drawing Sheets

WIRELESS POWERLESS SWITCH SENSOR

BACKGROUND OF THE INVENTION

1. Field of the Invention

The present invention relates, in general, to switch sensors and, more particularly, to monitoring the status of a switch sensor for use in a door actuation mechanism of a mass transit vehicle.

2. Description of Related Art

Power door operators for mass transit vehicles have been developed to reduce the strain on vehicle operators caused by the repeated opening and closing of vehicle doors. An example of such a power door operator is described in U.S. Pat. No. 6,125,768 which discloses a door system for transit vehicles that uses an electrically driven operator to open and close the doors of a mass transit vehicle. An exiting passenger using a touch bar or some other type of mechanical means can actuate such door operators. However, the use of a Radio Frequency Identification (RFID) system has not been envisioned for use as a mass transit door actuation means.

An RFID system begins with a "Tag" or "Transponder". The "Tag" or "Transponder" can be attached to or embedded within objects. An RFID reader sends out a radio frequency wave to the "Tag" and the "Tag" broadcasts back its stored data to the reader. The system works basically as two separate antennas, one on the "Tag" and the other on the reader. The data collected from the "Tag" can either be sent directly to a host computer through standard interfaces, or it can be stored in a portable reader and later uploaded to the computer for data processing. See U.S. Pat. No. 6,863,220.

One of the advantages of an RFID tag system is that it performs effectively in environments with excessive dirt, dust, moisture, or poor visibility, such as in a mass transit door actuation device. Currently, RFID is used largely in retail functions, such as inventory control, product identification and tracking, and automated checkout.

Currently, switch status sensors require complex wiring, power supplies, and even micro-controllers in order for them to function properly. Accordingly, a need exists for a switch sensor that functions properly in environments with excessive dirt, dust, moisture, and/or poor visibility and a switch sensor that does not require complex wiring, power supplies, and/or micro-controllers.

SUMMARY OF THE INVENTION

The present invention is also directed to a passenger door open request system. The passenger door open request system includes a door operator for controlling the opening and closing of a door mounted to a door frame of a multi-passenger mass transit vehicle, a door open request switch mounted on the door, a controller comprising an RFID reader antenna and a logic unit, a circuit formed by connecting an RFID antenna with a control/storage element, and a switch connected between the antenna and the control/storage element. The logic unit of the controller is coupled to the door operator and the switch is coupled to the door open request switch.

Further details and advantages of the present invention will become apparent upon reading the following detailed description in conjunction with the accompanying drawings.

DETAILED DESCRIPTION OF A PREFERRED EMBODIMENT

The present invention will be described with reference to the accompanying figures, wherein like reference numbers correspond to like elements throughout.

Figure 1:
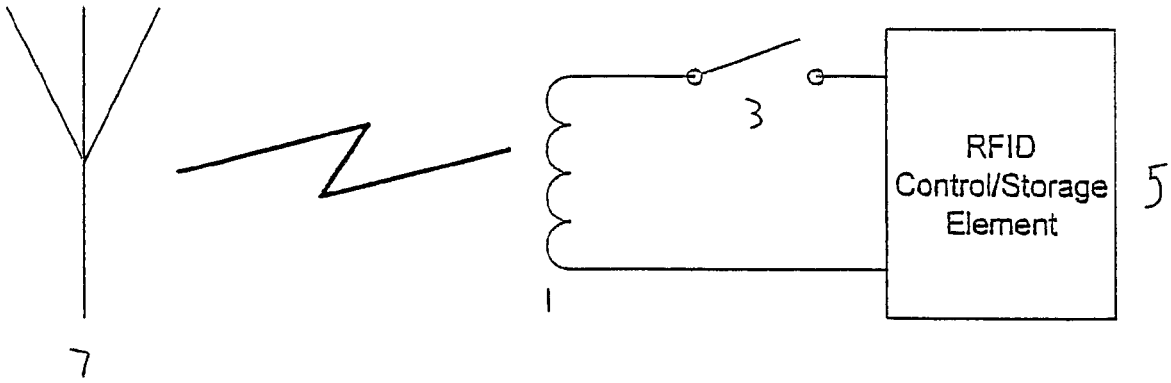
FIG. 1 is a schematic diagram of one embodiment of a wireless, powerless switch sensor useful in the present invention.

With reference to FIG. 1, a wireless, powerless switch sensor includes an RFID device antenna 1, connected in series with a switch 3 and an RFID control/storage element 5. The system also includes an RFID reader antenna 7 remote to RFID device antenna 1, switch 3, and control/storage element 5. RFID reader antenna 7 sends a Radio Frequency (RF) "request", which is received by RFID device antenna 1. The "request" allows control/storage element 5 to obtain enough power to turn on and respond as requested. Switch 3 is used to enable (i.e., switch is turned on) or disable (i.e., switch is turned off) RFID device antenna 1. This allows the system to monitor the status of the switch since the system will only provide a response if switch 3 is closed. Therefore, a response would indicate a closed switch, while no response would indicate an open switch. The opposite is also true. Switch 3 could be configured to short out RFID device antenna 1. This configuration would provide similar functionality, but in this case a response would indicate an open switch and no response would indicate a closed switch.

Since the present invention uses RFID technology, a switch sensor is provided that performs effectively in environments with excessive dirt, dust, moisture or poor visibility. The wireless, powerless switch sensor of the present invention also eliminates the need for wires, power supplies, and micro-controllers needed in prior art switch sensor systems, thereby reducing installation and maintenance costs and providing increased reliability.

Figure 2A:
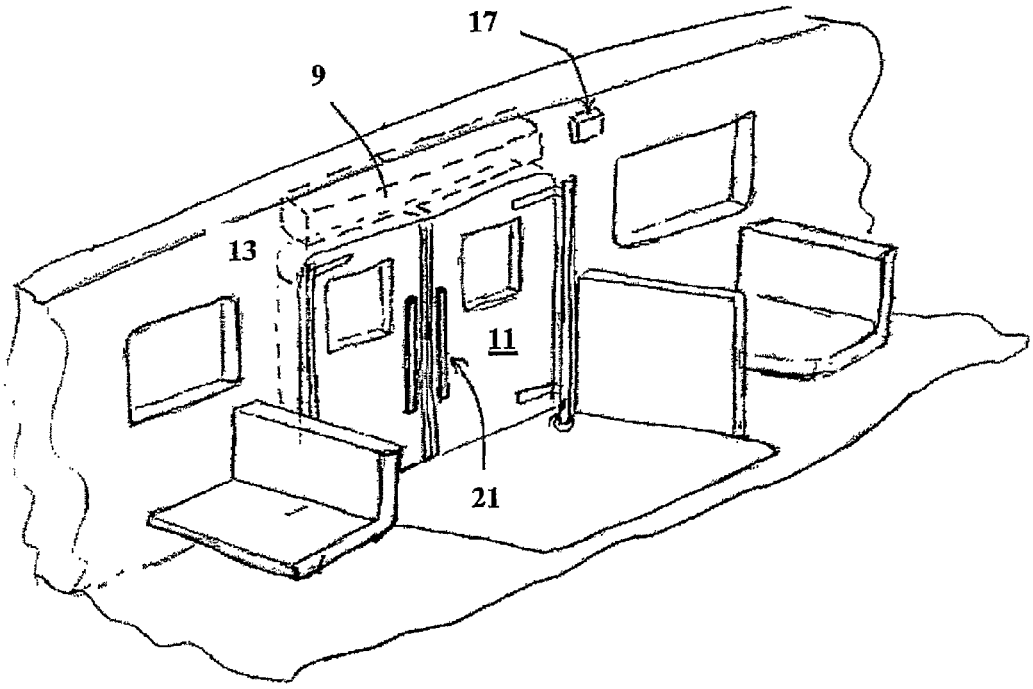
FIG. 2*a* is a perspective view of a multi-passenger mass transit vehicle door system implementing the present invention.
Figure 2B:
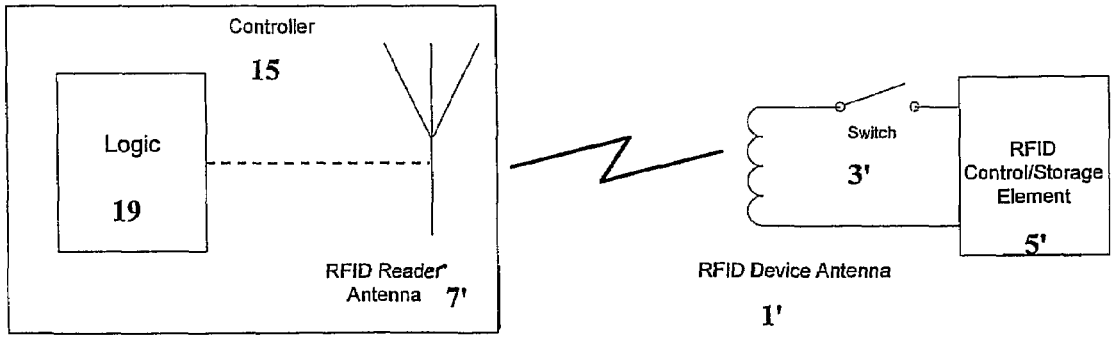
FIG. 2*b* is a schematic diagram of another embodiment of a wireless, powerless switch sensor for use in a multi-passenger mass transit vehicle in accordance with the present invention.

With reference to FIGS. 2*a* and 2*b*, a door system for a multi-passenger mass transit vehicle includes a power door operator 9 and doors 11 pivotally mounted on a doorframe 13 of the mass transit vehicle. A controller 15 may be integrated into power door operator 9 or it may be located anywhere inside the mass transit vehicle, such as area 17. Controller 15 includes logic circuitry 19 and an RFID reader antenna 7'. The system further includes a door open request switch 21. Door open request switch 21 is comprised of an RFID device antenna 1', a switch 3', and an RFID control/storage element 5'.

The system functions as follows: RFID reader antenna 7', activated by logic circuitry 19 in controller 15, repetitively transmits and awaits a response. If switch 3' is configured as shown in FIG. 2*b* (i.e., open), no response will be received by RFID reader antenna 7'. When a passenger presses door open request switch 21, switch 3' is closed connecting RFID control/storage element 5' to RFID device antenna 1'. RFID control/storage element 5' is thereby energized by the signal transmitted from RFID reader antenna 7'. RFID control/storage element 5' in turn transmits a response received by RFID reader antenna 7' that provides an indication to logic circuitry 19 of controller 15 that the state of switch 3' has changed. This indicates that a door open request has been received. Controller 15 then signals power door operator 9 to open doors 11 to allow the passenger to exit the mass transit vehicle.

While the present invention was described with reference to preferred embodiments of the wireless, powerless switch sensor, those skilled in the art may make modifications and alterations to the present invention without departing from the scope and spirit of the invention. Accordingly, the above detailed description is intended to be illustrative rather than restrictive.

The invention claimed is:

1. A passenger door open request system for a multi-passenger mass transit vehicle comprising:

a door operator for controlling the opening and closing of a door mounted to a doorframe of a multi-passenger mass transit vehicle;

a door open request switch mounted on or near the door;

a controller comprising an RFID reader antenna and a logic unit, wherein the logic unit of the controller is coupled to the door operator, said RFID reader antenna repetitively transmitting and awaiting a response;

an RFID circuit formed by connecting an RFID antenna with a control/storage element and an electrical switch connected to said RFID antenna, wherein the electrical switch is coupled to the door open request switch such that when the door open request switch is closed, the RFID circuit responds to the controller to cause the door to open.

* * * * *